US008086148B2

(12) United States Patent
Kataoka et al.

(10) Patent No.: US 8,086,148 B2
(45) Date of Patent: Dec. 27, 2011

(54) ELECTROPHOTOGRAPHIC IMAGE FORMING APPARATUS

(75) Inventors: Kaoru Kataoka, Kanagawa (JP); Akio Tsujita, Ibaraki (JP); Katsuhiko Suzuki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 394 days.

(21) Appl. No.: 12/391,703

(22) Filed: Feb. 24, 2009

(65) Prior Publication Data

US 2009/0214270 A1 Aug. 27, 2009

(30) Foreign Application Priority Data

Feb. 26, 2008 (JP) ..... 2008-044139

(51) Int. Cl.
*G03G 15/08* (2006.01)

(52) U.S. Cl. ..... 399/266

(58) Field of Classification Search ..... 399/252, 399/265, 266, 290–295
See application file for complete search history.

(56) References Cited

U.S. PATENT DOCUMENTS

| | | | | |
|---|---|---|---|---|
| 5,142,336 | A * | 8/1992 | Hotomi et al. | 399/281 |
| 6,477,351 | B1 * | 11/2002 | Thayer et al. | 399/350 |

FOREIGN PATENT DOCUMENTS

| | | |
|---|---|---|
| JP | 2001-139144 | 5/2001 |
| JP | 2002-287484 | 10/2002 |
| JP | 2004-198675 | 7/2004 |
| JP | 2004-341311 | 12/2004 |
| JP | 2005-195953 | 7/2005 |
| JP | 4179803 | 9/2008 |

* cited by examiner

*Primary Examiner* — David Porta
*Assistant Examiner* — Shun Lee
(74) *Attorney, Agent, or Firm* — Oblon, Spivak, McClelland, Maier & Neustadt, L.L.P.

(57) ABSTRACT

An electrophotographic image forming apparatus is disclosed. The electrophotographic image forming apparatus includes a photoconductor body, a donor roller which develops an electrostatic latent image on the surface of the photoconductor body by using charged toners, and a development nip section formed between the photoconductor body and the donor roller by having a predetermined gap between the photoconductor body and the donor roller. A developing traveling-wave electrode for generating a traveling-wave electric field is disposed at a position facing the surface of the donor roller at an upstream side of the moving direction of the photoconductor body relative to the development nip section, and a removing traveling-wave electrode for generating a traveling-wave electric field is disposed at a position facing the surface of the donor roller at a downstream side of the moving direction of the photoconductor body relative to the development nip section.

7 Claims, 2 Drawing Sheets

ELECTROPHOTOGRAPHIC IMAGE FORMING APPARATUS

BACKGROUND OF THE INVENTION

1. Field of the Invention

The present invention generally relates to an electrophotographic image forming apparatus, which is used in apparatuses such as a copying apparatus, a facsimile apparatus, and a laser printer, in which an image is formed by using an electrostatic latent image.

2. Description of the Related Art

Conventionally, when an electrostatic latent image is developed by using a two-component developer formed of toners and a toner carrier, due to dispersion of an electric field by a magnetic brush formed by the toner carrier and a mechanical scraping of the toners due to the magnetic brush, a toner image formed after developing the electrostatic latent image on a surface of a photoconductor body is degraded. In order to solve the above problem, a developing system has been studied in which the electrostatic latent image on the surface of the photoconductor body is developed by causing only a donor roller to carry the toners.

In a multiple color development process, when a developed toner image of a color exists on a surface of the photoconductor body and plural development processes are performed to superpose other color images on the developed toner image, damage to a previously developed toner image on the surface of the photoconductor body must be low.

In order to solve the above problem, a developing system, for example, a non-contact developing system has been proposed. For example, in the system, the toners are caused to fly from the donor roller by disposing an electric charge wire between the photoconductor body and the donor roller. In another system, the toners are caused to fly by using a traveling-wave electric field curtain formed by a traveling-wave electrode without using the donor roller. In addition, in another system, the toners are ejected from holes of the traveling-wave electrode. In particular, in a developing system in which a toner cloud is generated by using the traveling-wave electrode, Patent Document 1 discloses a technology in which the traveling-wave electrodes face each other, and Patent Document 2 discloses a technology in which electrodes face each other.

[Patent Document 1] Japanese Unexamined Patent Publication No. 2002-287484

[Patent Document 2] Japanese Unexamined Patent Publication No. 2001-139144

In a developing system using a donor roller, when an electrostatic latent image is developed by toners flying onto the surface of the photoconductor body via a gap at a development nip section, a high electric field is required so that the toners electrostatically firmly adhered onto the surface of the donor roller are caused to fly from the donor roller. Generally, a surface electric potential which can be sustained by the photoconductor body is approximately 1 kV at most, and the surface electric potential has an upper limit. Consequently, in order to increase the electric field of the developing region, the gap between the photoconductor body and the donor roller must be small or the photoconductor body and the donor roller must be contacted.

However, in the non-contact developing system, in order to obtain a uniform electric field, the gap between the photoconductor body and the donor roller must be great to an extent that the influence of a roller manufacturing error can be ignored; and a sufficiently narrow gap is hardly obtained.

Alternatively, a highly precise donor roller must be manufactured; however, in this case, the cost becomes high.

On the other hand, when the donor roller is to contact the photoconductor body, the stress to be applied to the toners becomes greater than that in the case of the non-contact developing system, and the printed service life of the toners may be shortened and the toners may be fused and adhered onto the donor roller. In addition, in this case, when multiple colors are superposed, contamination such as color mixture likely occurs on the photoconductor body, and the contact developing system is hardly used in a high-speed printing system.

In the non-contact developing system, in order to greatly separate the toners from the donor roller, there is a method in which an AC electric field is added to a DC electric field; however, when the AC electric field to be added is too great, a so-called background overlapping caused by toners adhering onto a non-image forming section may occur, and contamination may occur caused by superposing multiple colors on the surface of the photoconductor body where a color image has been developed.

In addition, in order to separate the toners from the donor roller, there is a method in which the AC electric field is functionally separated from the DC electric field by disposing an AC wire near the donor roller; however, since the AC electric field influences a developing electric field in the development nip section, the AC electric field must not be too great. Further, in the developing system using the donor roller, when the toners adhered onto the surface of the donor roller are not removed from the surface of the donor roller after the development, the charged toner amount stored on the donor roller is great, and the developer concentration may be lowered.

As described above, in the non-contact developing system in which the toners are caused to fly by using the traveling-wave electric field curtain, the toners are likely to fly inside the apparatus.

SUMMARY OF THE INVENTION

In a preferred embodiment of the present invention, there is provided an electrophotographic image forming apparatus in which an image is formed by using an electrostatic latent image and image degradation caused by toner flying at a development nip section and color mixture in a multiple color image are prevented.

Features and advantages of the present invention are set forth in the description that follows, and in part will become apparent from the description and the accompanying drawings, or may be learned by practice of the invention according to the teachings provided in the description. Features and advantages of embodiments of the present invention will be realized and attained by an electrophotographic image forming apparatus particularly pointed out in the specification in such full, clear, concise, and exact terms so as to enable a person having ordinary skill in the art to practice the invention.

To achieve one or more of these and other advantages, according to one aspect of the present invention, there is provided an electrophotographic image forming apparatus. The electrophotographic image forming apparatus includes a photoconductor body which moves at a predetermined process speed having an electrostatic latent image on a surface of the photoconductor body, a donor roller which moves by facing the photoconductor body in a direction equal to or opposite to a moving direction of the photoconductor body and develops the electrostatic latent image on the surface of the photoconductor body by using charged toners electrostatically carried on a surface of the donor roller, and a development nip section formed between the photoconductor body and the donor roller by having a predetermined gap between the photoconductor body and the donor roller. A developing traveling-wave electrode for generating a traveling-wave electric field is disposed at a position facing the surface of the donor roller at an upstream side of the moving direction of the photoconductor body relative to the development nip section separated from the donor roller, and a traveling direction of a traveling-wave electric field from the developing traveling-wave electrode is toward a side of the development nip section. In addition, a removing traveling-wave electrode for generating a traveling-wave electric field is disposed at a position facing the surface of the donor roller at a downstream side of the moving direction of the photoconductor body relative to the development nip section separated from the donor roller, and a traveling direction of a traveling-wave electric field from the removing traveling-wave electrode is away from the development nip section.

EFFECT OF THE INVENTION

According to an embodiment of the present invention, in an electrophotographic image forming apparatus using a donor roller, before developing an electrostatic latent image on a surface of a photoconductor body, a developing traveling-wave electrode disposed facing the donor roller generates a traveling-wave electric field and the traveling-wave electric field gives a transporting force to toners in a traveling-wave electric field traveling direction, and the toners are separated from the surface of the donor roller when a distance between the developing traveling-wave electrode and the donor roller is gradually increased. With this, the toners are smoothly separated from the surface of the donor roller. The traveling-wave electric field releases the toners at an upstream side of a development nip section and a substantially large development nip section can be obtained. With this, the electrostatic latent image on the surface of the photoconductor body is smoothly developed by the toners even in a multiple color printing. In addition, a toner reciprocating movement is generated between the donor roller and the developing traveling-wave electrode at the upstream side of the development nip section, and the toners are charged up and the toners adhered on the surface of the donor roller may be flown from the surface of the donor roller. After the development of the electrostatic latent image, a traveling-wave electric field generated by a removing traveling-wave electrode removes remaining toners adhered on the surface of the donor roller and the toners are returned to a developer sink.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

Best Mode of Carrying Out the Invention

The best mode of carrying out the present invention is described with reference to the accompanying drawings.

In embodiments of the present invention, in an electrophotographic image forming apparatus using a donor roller, a developing traveling-wave electrode, which generates a traveling-wave electric field traveling in a direction toward a development nip section, is disposed facing the donor roller at an upstream side of the development nip section, and a distance between the developing traveling-wave electrode and a surface of the donor roller becomes greater in the direction from the developing traveling-wave electrode to the downstream side of the rotational direction of the donor roller. Toners transported by the traveling-wave electric field are separated from the surface of the donor roller and are released from the developing traveling-wave electrode at a position between the photoconductor body and the donor roller, and form a toner cloud while the toners reach the development nip section. In addition, a removing traveling-wave electrode, which generates a traveling-wave electric field, is disposed for the toners on the surface of the donor roller after development; the toners adhered onto the surface of the donor roller are removed from the surface of the donor roller, transported onto the removing traveling-wave electrode, and are returned in a developer sink where the developer is agitated.

First Embodiment

Figure 1:
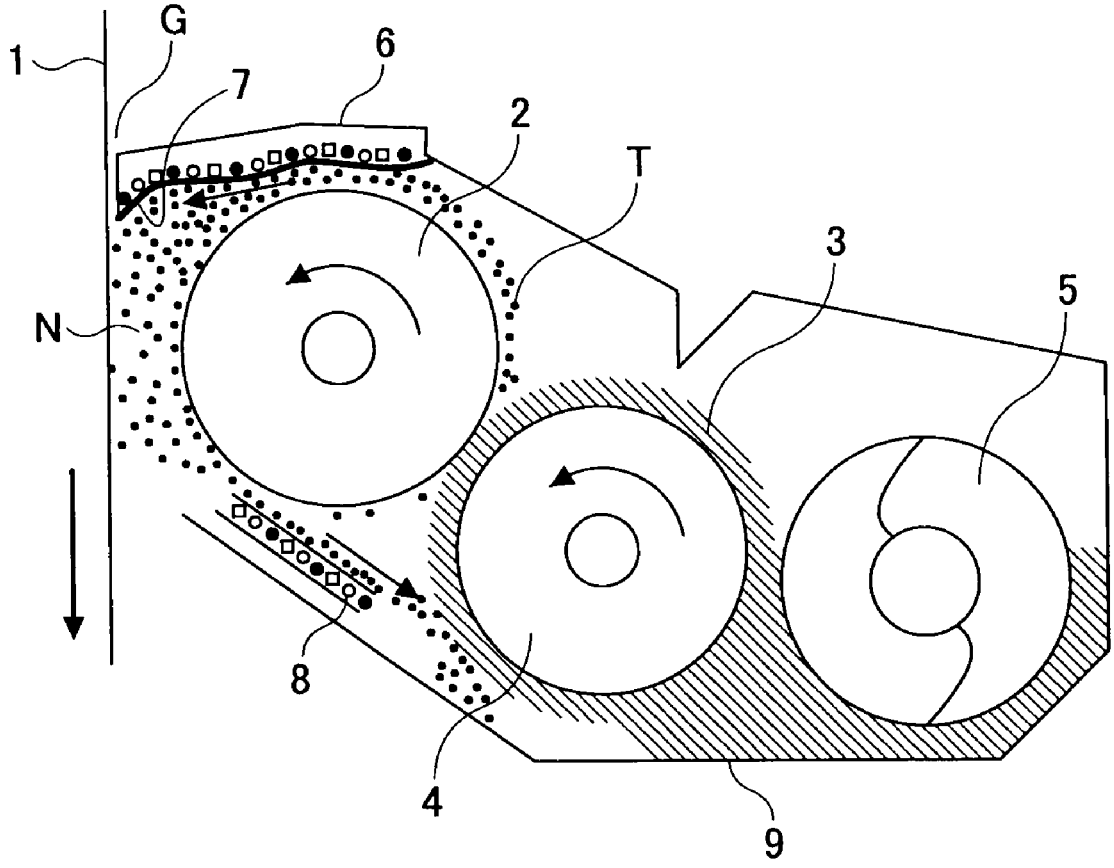
FIG. 1 is a schematic diagram showing a developing device in an electrophotographic image forming apparatus according to a first embodiment of the present invention.

FIG. 1 is a schematic diagram showing a developing device in an electrophotographic image forming apparatus according to a first embodiment of the present invention.

In FIG. 1, a web-type (sheet-type) photoconductor body 1 wound around rollers (not shown) is moved at a predetermined process speed, and a development nip section N is formed between the photoconductor body 1 and a donor roller 2. Toners T are supplied from a two-component developer 3 on a surface of the donor roller by a developing roller 4 formed of a rotation sleeve containing a stationary magnet and an auger screw 5. In order to transport the toners T to the surface of the donor roller 2, a potential gradient is formed between the donor roller 2 and the developing roller 4. The toners T are negatively charged, the voltage of the donor roller 2 is determined to be −300 V, and the voltage of the developing roller 4 is determined to be around −600 V; with this, the amount of the toners T to be adhered onto the surface of the donor roller 2 is adjusted.

In the above, the voltages are DC voltages; however, an AC voltage can be added to the DC voltages. The diameter of the donor roller 2 is, for example, 50 mm, and the speed of the donor roller 2 is, for example, 230 rpm. The toner concentration in the two-component developer 3 is, for example, 5 wt %. The rotational direction of the donor roller 2 can be the same direction as the moving direction of the photoconductor body 1 or the opposite direction of the moving direction of the photoconductor body 1. In the present embodiment, the same direction is used.

In addition, in FIG. 1, a developing traveling-wave electrode 6, which generates a traveling-wave electric field traveling in the direction of the development nip section N, is disposed at the upstream side of the development nip section N. At a position near a traveling-wave electric field starting point of the developing traveling-wave electrode 6, a reciprocating movement of the toners T is generated between the donor roller 2 and the developing traveling-wave electrode 6, the charge amount of the toners T rises, flying toners T hit the toners T adhered onto the surface of the donor roller 2, and much more of the toners T fly. The flying toners T are guided by the traveling-wave electric field and are transported to a position near the photoconductor body 1, and a toner cloud is formed by toners being released from the developing traveling-wave electrode 6. In the present embodiment, at the developing traveling-wave electrode 6, the voltage is 600 V and the frequency is 5 kHz; however, the voltage can be 100 to 2500 V and the frequency can be 1 to 20 kHz.

In order for the toners T transported by the traveling-wave electric field to not directly hit the photoconductor body 1, at a position near the traveling-wave ending point of the developing traveling-wave electrode 6, a curved section 7 is formed extending the moving direction of the photoconductor body 1.

A minute gap G having a sealing function is disposed between a tip of the developing traveling-wave electrode 6 and the photoconductor body 1. When air is introduced into the gap G by the movement of the photoconductor body 1, a minute concentration gradient is formed between the toners T and the surface of the photoconductor body 1. When the electric field on the photoconductor body 1 attracts the toners T, the toners T reach the surface of the photoconductor body 1, and a toner cloud is formed. After this, at the development nip section N where the donor roller 2 approaches the photoconductor body 1, since the strength of the electric field becomes great, extra toners T adhered onto the surface of photoconductor body 1 are trimmed (removed), and when the development is insufficient, the toners T are supplied.

A removing traveling-wave electrode 8 is disposed at a position near under the donor roller 2 at the downstream side of the development nip section N, and the traveling-wave electric field travels in the direction toward a developer sink 9 containing the two-component developer. The toners T captured by the removing traveling-wave electrode 8 are moved along the removing traveling-wave electrode 8, and are returned in the two-component developer 3 in the developer sink 9.

The toners T remaining on the surface of the donor roller 2 without being captured by the removing traveling-wave electrode 8 are removed from the donor roller 2 by a counter charge of the donor roller 2, after the development generated by a magnetic brush of the developing roller 4, and a mechanical scraping generated by the magnetic brush. With this, the remaining toners T are effectively removed from the surface of the donor roller 2, and an electrostatic latent image on the surface of the photoconductor body 1 can be developed with a soft contact force of the toners T on the surface of the photoconductor body 1. With this, a high-speed development of the electrostatic latent image with high resolution can be performed. In addition, since the flying toners T are confined between the removing traveling-wave electrode 8 and the donor roller 2, the flying amount of the toners T can be made small.

Second Embodiment

Figure 2:
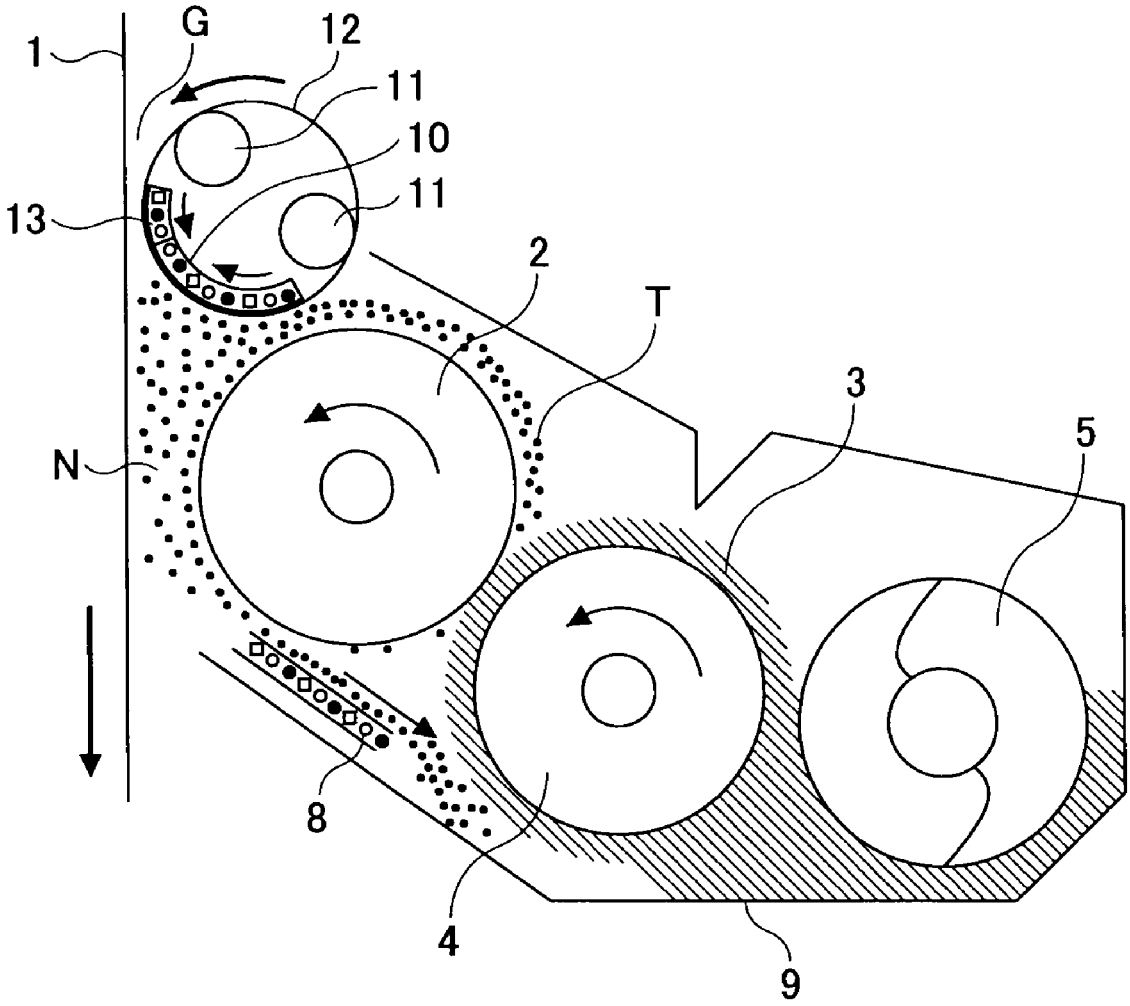
FIG. 2 is a schematic diagram showing a developing device in an electrophotographic image forming apparatus according to a second embodiment of the present invention.

FIG. 2 is a schematic diagram showing a developing device in an electrophotographic image forming apparatus according to a second embodiment of the present invention.

In the first embodiment of the present invention, the developing traveling-wave electrode 6 is directly secured to the developing device. However, as shown in FIG. 2, in the second embodiment of the present invention, a thin insulation film 12 is wound around a developing traveling-wave electrode 10 and a pair of rollers 11, and the thin insulation film 12 is rotated at a slow speed of 1 rps or less counterclockwise. In addition, an electrode 13 (a part of the developing traveling-wave electrode 10), which generates a traveling-wave electric field having the direction opposite to the direction of the developing traveling-wave electrode 10, is formed at a position near the end of the developing traveling-wave electrode 10 which releases the toners T so that the toners T hit each other. When the insulation film 12 is moved, the toners T are prevented from staying on the surface of the donor roller 2 such as when the toners T cannot be moved. In addition, since the traveling-wave electric field having the opposite direction to that of the developing traveling-wave electrode 10 is generated at the position near the photoconductor body 1, the toners T near the end of the developing traveling-wave electrode 10 can be easily separated from the surface of the donor roller 2. The position of the electrode 13 can be in the middle of the developing traveling-wave electrode 10.

In addition, an electrode having a traveling-wave electric field whose direction is opposite to that of the removing traveling-wave electrode 8 can be formed in the middle of the removing traveling-wave electrode 8.

In FIG. 2, the other elements are the same as those shown in FIG. 1.

The voltages of the traveling-wave electrodes 10, 8, and 13 are determined to be one set of voltages. However, for example, the electric potential can be lowered at the tip of an electrode by changing a resistance value at the tip of the electrode, or the electric potential can be changed in each of the electrodes, if necessary.

In addition, when the traveling-wave electrode is divided into plural electrodes in the width direction of printing and the traveling-wave electric field is generated in a width corresponding the width of the printing paper, the flying of the toners T can be effectively prevented inside the apparatus, and toner filming on the surface of the photoconductor body 1 caused by excessive toner supply can be prevented.

Further, the present invention is not limited to the embodiments, but variations and modifications may be made without departing from the scope of the present invention.

The present invention is based on Japanese Priority Patent Application No. 2008-044139, filed on Feb. 26, 2008, with the Japanese Patent Office, the entire contents of which are hereby incorporated herein by reference.

What is claimed is:

1. An electrophotographic image forming apparatus, comprising:

a photoconductor body which moves at a predetermined process speed, the photoconductor body to have an electrostatic latent image on a surface thereof;

a donor roller which moves based on movement of the photoconductor body in a direction equal to or opposite to a moving direction of the photoconductor body and develops the electrostatic latent image on the surface of the photoconductor body by using charged toner electrostatically carried on a surface of the donor roller;

a development nip section formed between the photoconductor body and the donor roller by having a predetermined gap between the photoconductor body and the donor roller; and a developing traveling-wave electrode for generating a traveling-wave electric field disposed at a position facing the surface of the donor roller at an upstream side of the moving direction of the photoconductor body relative to the development nip section separated from the donor roller, a traveling direction of the traveling-wave electric field from the developing traveling-wave electrode is toward a side of the development nip section, wherein:

a distance between the donor roller and the developing traveling-wave electrode is greater at a downstream side than at an upstream side of the traveling direction of the traveling-wave electric field, and the toner is released from the side of the developing traveling-wave electrode to the side of the development nip section.

2. The electrophotographic image forming apparatus as claimed in claim 1, wherein:

a tip of the developing traveling-wave electrode at the side of the development nip section is curved in the moving direction of the photoconductor body.

3. The electrophotographic image forming apparatus as claimed in claim 1, wherein:

the developing traveling-wave electrode includes a minute gap between the photoconductor body and the developing traveling-wave electrode at the side of the development nip section.

4. The electrophotographic image forming apparatus as claimed in claim 1, further comprising:

a removing traveling-wave electrode for generating a traveling-wave electric field disposed at a position facing the surface of the donor roller at a downstream side of the moving direction of the photoconductor body relative to the development nip section separated from the donor roller, a traveling direction of a traveling-wave electric field from the removing traveling-wave electrode is away from the development nip section.

5. The electrophotographic image forming apparatus as claimed in claim 4, wherein:

a distance between the donor roller and the removing traveling-wave electrode is greater at a downstream side than at an upstream side of the traveling direction of the traveling-wave electric field; and the toner is released from the surface of the donor roller to the side of the removing traveling-wave electrode.

6. The electrophotographic image forming apparatus as claimed in claim 4, wherein:

the removing traveling-wave electrode includes an electrode whose traveling direction of the traveling-wave electric field is reversed at least at one of a position at the tip and a position at the middle of the removing traveling-wave electrode.

7. The electrophotographic image forming apparatus as claimed in claim 1, wherein:

the developing traveling-wave electrode includes an electrode whose traveling direction of the traveling-wave electric field is reversed at least one of a position at the tip and a position at the middle of the developing traveling-wave electrode.

* * * * *